United States Patent [19]

Fraige

[11] Patent Number: 4,607,404

[45] Date of Patent: Aug. 26, 1986

[54] WATERBED FLOAT WITH ANTIWAVE HANGING BAFFLE AND COLLAPSE-RETARDING FIBER INSERT

[76] Inventor: Richard Fraige, 11005 Highway 50 East, Carson City, Nev. 89701

[21] Appl. No.: 630,886

[22] Filed: Jul. 13, 1984

Related U.S. Application Data

[63] Continuation-in-part of Ser. No. 535,619, Sep. 26, 1983, Pat. No. 4,523,343, which is a continuation-in-part of Ser. No. 337,122, Jan. 5, 1982, Pat. No. 4,481,248.

[51] Int. Cl.[4] ..... A47C 27/08

[52] U.S. Cl. ..... 5/450; 5/451

[58] Field of Search ..... 5/451, 450, 452, 457, 5/458, 422, 455

[56] References Cited

U.S. PATENT DOCUMENTS

| | | | |
|---|---|---|---|
| 2,781,820 | 2/1957 | Rogers | 5/450 |
| 4,296,510 | 10/1981 | Phillips | 5/450 |
| 4,325,152 | 4/1982 | Carpenter | 5/451 |
| 4,345,348 | 8/1982 | Hall | 5/451 |
| 4,399,575 | 8/1983 | Hall | 5/451 |
| 4,475,257 | 10/1984 | Phillips | 5/451 |

OTHER PUBLICATIONS

"DEL-ASTRA", an ad from the Sep. 1982 issue of "Flotation Sleep Industry".

"Ultra Sleep", a trade pamphlet, ©1982, available from Monterey Manufacturing, Carson, CA.

"Max", an ad in the Jul. 1982 issue of "Flotation Sleep Industry".

*Primary Examiner*—Alexander Grosz

*Attorney, Agent, or Firm*—Romney Golant Martin Seldon & Ashen

[57] ABSTRACT

Hydraulic chambers for attenuation of wave motion within waterbed mattresses are buoyed by encapsulated material made of a large multiplicity of interbonded fibers.

8 Claims, 3 Drawing Figures

WATERBED FLOAT WITH ANTIWAVE HANGING BAFFLE AND COLLAPSE-RETARDING FIBER INSERT

RELATED APPLICATIONS

This is a continuation in part of my copending U.S. patent application Ser. No. 535,619, filed Sept. 26, 1983, and now issued as U.S. Pat. No. 4,523,343, entitled "Novel Buoyant Fiber Product Used in Improved Waterbed Float with Hanging Baffle," which was in turn a continuation in part of my then copending U.S. patent application Ser. No. 337,122, filed Jan. 5, 1982, which has now issued as U.S. Pat. No. 4,481,248.

BACKGROUND

1. Field of the Invention

This invention relates generally to waterbeds, and more particularly to systems for reducing undesirable wave motion within waterbed mattresses in response to movement of individuals sitting or lying on such mattresses.

This invention also relates generally to fiber products and to methods for their manufacture, and more particularly to a bonded fiber product previously shown to be useful when placed directly within a waterbed mattress—and here shown to be useful when placed within a float that is used to support a wave-retarding baffle in a waterbed mattress.

2. Prior Art (a) Hanging baffles in general—Some systems for reducing wave motion within waterbed mattresses use a baffle or baffles hung from a buoyant structure or structures. In some cases the baffle is contoured in various ways, and in particular when the baffle is contoured to form a closed or nearly closed structure it has been called a "hydraulic chamber".

In all hanging-baffle systems, wave energy is expended (against internal friction of the water) in moving the baffle—and also, more importantly, in moving a body of water that is behind or within the baffle.

(b) Hydraulic chambers—A hydraulic chamber is a preferably nonwatertight inner compartment which damps undesirable waves by the inertia and internal friction of enclosed water. Because it is vented, a hydraulic chamber allows relatively slow inward and outward water flow, to accommodate filling of the mattress—and to accommodate relatively slow shifts of water distribution, thereby helping the waterbed mattress to adjust to the position of a person lying on the bed.

The unsealed apertures in the chamber are small enough, however, to cause the chamber to behave essentially as a unit in response to transients caused by relatively abrupt motions of the occupant. This latter effect helps to resist and thereby reduce the undesirable wave motion.

(c) Floats in general—Hydraulic chambers have been supported by buoyant structures or "floats" of various kinds, including buoyant pads, sheets or blocks of polyethylene foam, within the mattress. Typically the buoyant structure floats just below the upper panel of the mattress, and the chamber hangs toward (but generally not all the way to) the bottom panel of the mattress.

Such buoyant structures, with hanging baffles attached, help to inhibit formation as well as propagation of waves within the mattress. They also impart a relatively firm "feel", since they float immediately below and in contact with the mattress top panel, and so can be felt by a user/occupant. Many users prefer such a firm "feel"; however, generally they do not like to distinctly sense the buoyant structure itself or the baffle itself as a distinct object. Consequently a layer of fiber is generally or often added on the top of the buoyant structure.

(d) Polyethylene-foam pads as floats—Prior buoyant pads used to support hydraulic chambers have been made of polyethylene. Unfortunately, even closed-cell polyethylene has a tendency to slowly waterlog and eventually sink. A representative of the Dow Chemical Company, which makes this material, has explained to me:

> "Under long-term submersion conditions, polyethylene foam sheet can be expected to pick up some quantity of water, even though the foam has a closed-cell structure. This is due to the slow migration of individual water molecules into and through the polyethylene cell walls. The buoyant force exerted by the foam would, of course, decrease as more and more water molecules make their way into the foam."

This manufacturer estimated the length of time required for this effect to become significant, under conditions pertinent to waterbeds, as "certainly a number of months and possibly several years," and went on to say "we have no data that would allow us to refine this further." I have heard reports of hydraulic-chamber floats waterlogging and sinking in as short a time as eight months, and even six.

Besides forfeiting its antiwave characteristics, a chamber or other continuous structure which sinks can also obstruct convection at the waterbed heater and thermostat. Depending on the geometry and on the electrical circuitry of these devices, various adverse conditions may result—such as causing the thermostat and heater to cycle on and off frequently, and/or to wear out entirely; and/or causing the heater to stay off continuously or to stay on continuously. In the last-mentioned case, accumulated heat could damage the mattress and liner, possibly even releasing the water from the mattress and causing water damage to the premises in which the mattress is installed.

Some mitigation of the uptake of water by polyethylene foam may be obtained by using relatively high-density foam. High-density foam presents a greater number of cell walls through which water must migrate to occupy the foam. Unfortunately, however, any material with higher density has correspondingly lower buoyancy, and polyethylene foam is no exception. Thus the manufacturer using floats made of polyethylene foam has a choice of providing brief buoyancy or lower buoyancy! The cost, weight and bulk implications of the latter are apparent. Bulk, in particular, is undesirable since it places a lower limit on the overall size of the unfilled waterbed mattress for shipment and storage.

One seductive solution to this problem is to encapsulate the polyethylene foam pad in vinyl—or in some other sheeting similar to that used for the mattress proper. There are several drawbacks to this solution, the most pertinent ones for present purposes being that the polyethylene foam remains relatively bulky for shipment.

(e) Inflated floats—In a related system, a hydraulic chamber is supported from a float that is buoyant by virtue of being inflated. In other words, this system uses a float which encapsulates air (or other gas).

The difficulty with this system is that consistent buoyancy is obtained with such a float only if the inflation pressure is adequate to maintain the shape and thus the volume of the float roughly constant. Unfortunately, however, if inflation pressure is high enough to satisfy this condition, the float is relatively stiff and rigid. Whenever there are minor movements of the water within the mattress, therefore, the float bumps very noticeably against the underside of the upper panel of the mattress—and thus against the occupant of the bed.

In summary, the inflated float suffers from either inconsistent buoyancy or excessive rigidity.

(f) Nonbuoyant fibrous matting used as a wave absorber—Other systems make use of fibrous mats placed within waterbed mattresses to absorb the energy of water motion caused by occupant movement; this is the subject of my U.S. Pat. No. 4,301,560. In these latter systems energy is absorbed in the flow of water through the bonded nonwoven polyester fibrous structure of the matting.

This approach to reducing wave motion can be used to provide a relatively soft "feel," preferred by some users. This kind of "feel" generally results from using fiber that is not significantly buoyant. (My U.S. Pat. No. 4,301,560 is not limited to providing this softer "feel.")

(g) Summary of the prior art—All of these various configurations strongly affect the "feel" of the finished mattress. As already noted, different users typically prefer different configurations.

In any wave-retarding article placed within a waterbed it is desirable that the design provide for some degree of optimization of the mechanical characteristics of the article at the time of manufacture, so that it can be inoffensive in its contact with the occupant of the bed.

A soft "feel" is readily attained by my waterbed mattress with fibrous-matting wave retarder. A harder "feel" is provided by hanging baffles (and particularly hydraulic chambers), but the technology of providing suitable floats is not yet satisfactory from all viewpoints.

In particular, polyethylene floats tend to sink unless encapsulated, and if encapsulated they are bulky in shipment. Inflated floats require excessive inflation pressures or bump against the occupant of the bed, and thus are not amenable to optimization of mechanical characteristics as noted above.

Earlier teachings thus fall short of providing a buoyant article for support of a hydraulic chamber that can be installed, shipped, and used economically.

SUMMARY OF THE INVENTION

My invention makes use of a relatively long-established and proven fiber product that was disclosed in my U.S. Pat. No. 4,301,560. That product is a preferably interbonded, nonwoven polyester fiber matting.

The fiber product is a highly lofted fibrous structure composed of a large multiplicity of fibers together with a binder. The binder is disposed over the fibers in such a way that substantially each fiber is bound to at least one other fiber.

The fiber product is manufactured by combining a binder, and a quantity of fibrous material. As preferred examples, the binder may be acrylic latex, and the fibrous material may be polyester fibers.

In this product the fibers may be randomly intertwined or interbonded. Alternatively if desired they may be woven, though this is not the form of the material which I prefer. Conventional automated assemby lines for producing bonded fiber are available. Essentially no manual labor is required; therefore, the cost of manufacturing the fiber is minimal.

A quantity of the fibrous product described above is placed within a sealed float structure—preferably a toroidal structure, or one that has two or more holes for ready communication between the space above and the space below the float. A suitable quantity of air or other gas is sealed inside the float with the fibrous product. A hanging baffle (preferably a hydraulic chamber) is suspended from or is integrally formed with the float structure.

The structure in turn is positioned within a waterbed mattress, where it will float near the top (providing a relatively firm sleeping surface) and impede the flow of water. Water within the mattress flows directly through the hole(s) in the float, and through or around the hanging baffles (preferably, through and around the hydraulic chamber). In the process, however, the energy of the flow is expended against internal friction of the water—particularly for rapid flow.

When a person sits down or lies down on the waterbed, or subsequently moves on the bed, sits up on the bed, or starts to get out of the bed, these movements transfer energy to the water within the waterbed mattress and thereby create waves within the mattress.

The energy in the waves, however, is quickly expended in flowing through and around the baffle suspended within the mattress; accordingly the objectionable wave action as felt by the user of the bed is greatly diminished. As a buoyant float is provided, the wave encounters the float and baffle immediately at formation.

Motion of water into or out of the hole(s) in the float immediately is required to sustain the wave, and the baffle therefore resists the *initiation* of the shock wave, dispersing the energy along the surface—as well as providing a firmer sleeping surface, which some users prefer.

The fibrous matting within the float tends to hold the shape of the float very roughly constant—in particular preventing a general collapse of the float, or other deformations that would greatly reduce the volume of the float and therefore its buoyancy. Because the fibers in this way impede collapse of the float, the float need not be firmly inflated. A much softer inflation is adequate, so the user does not feel the float as a distinct object bumping against the underside of the mattress top panel.

Furthermore, because the fibers are substantially stiffer than the structure of a polyethylene pad, a much smaller bulk of fibers can be used than would be required for an encapsulated polyethylene pad. Consequently for shipment purposes the inflated float of my invention, with its fiber insert in place, will be readily compressible to a much smaller volume than an encapsulated polyethylene pad.

All of the foregoing principles and advantages of the present invention will be more fully appreciated upon consideration of the following detailed description, with reference to the appended drawings, of which:

BRIEF DESCRIPTION OF THE DRAWINGS

FIG. 3 shows the thicknesses of the sheeting elements exaggerated relative to other dimensions in the drawing.

DETAILED DESCRIPTION OF THE INVENTION

Figure 1:
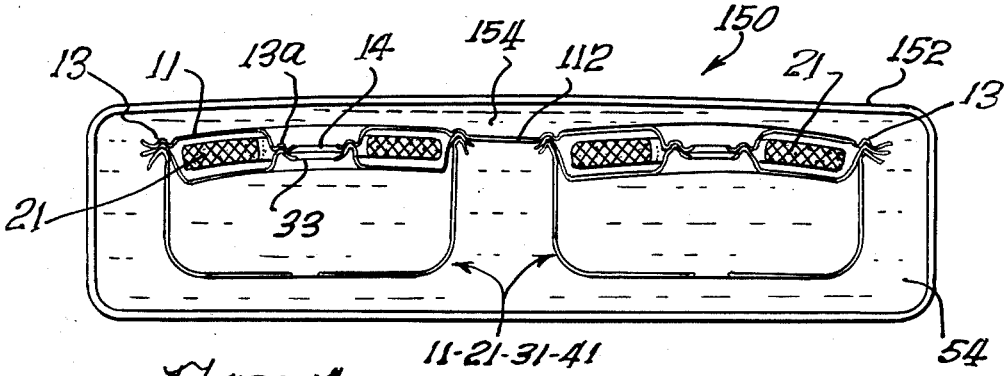
FIG. 1 is an end elevation, in section, of a waterbed mattress with my novel float installed for the purpose of suppressing wave motion and providing a relatively firm sleeping surface.

As shown in FIG. 1, a float-and-baffle assembly 11-21-31-41, or a plurality of such assemblies 11-21-31-41, is positioned within the outer shell 152 of a waterbed mattress 150. The waterbed is filled with water 154 before use as a bed.

In use the structures 11-21-31-41 float within and just below the upper panel of the envelope 152. The baffle portions of each structure, and also the holes in the float(s), greatly inhibit the formation of waves and "damp out" wave motion in the volume of water adjacent to the occupant of the waterbed. Purely as examples, each of the structures 11-21-31-41 may be roughly twenty inches square and eight inches tall.

Figure 2:
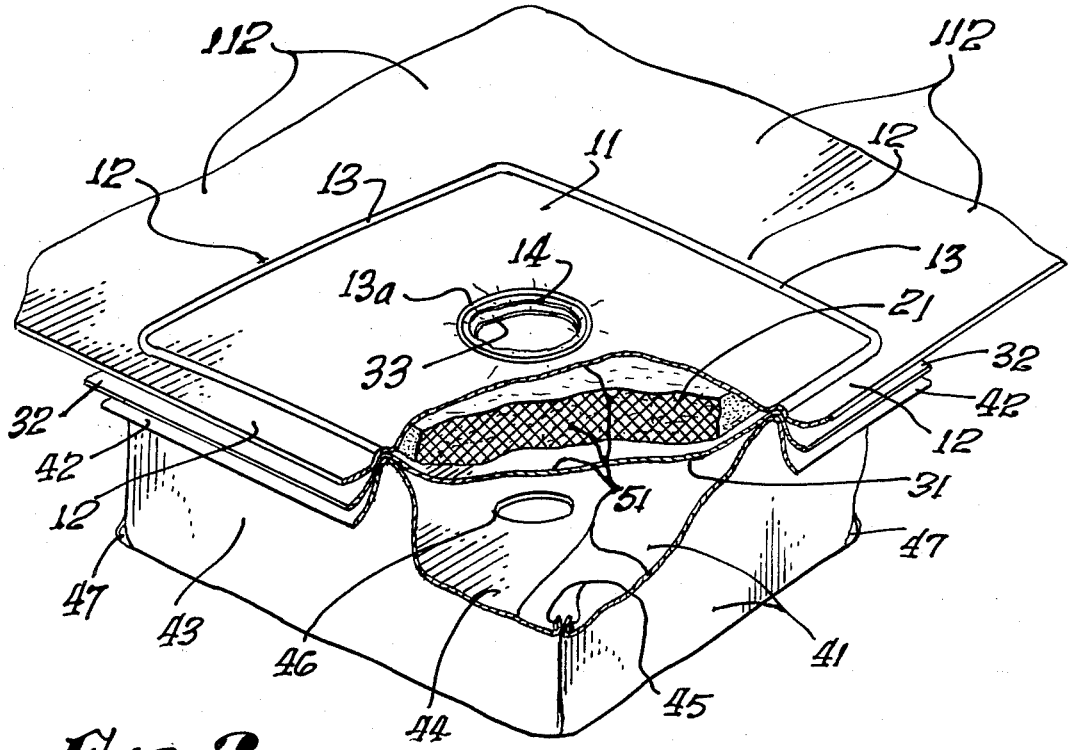
FIG. 2 is a generally perspective or isometric drawing, partly cut away and partly in section, showing a float with a fiber insert, in combination with a hydraulic chamber that is a preferred embodiment of my invention.
Figure 3:
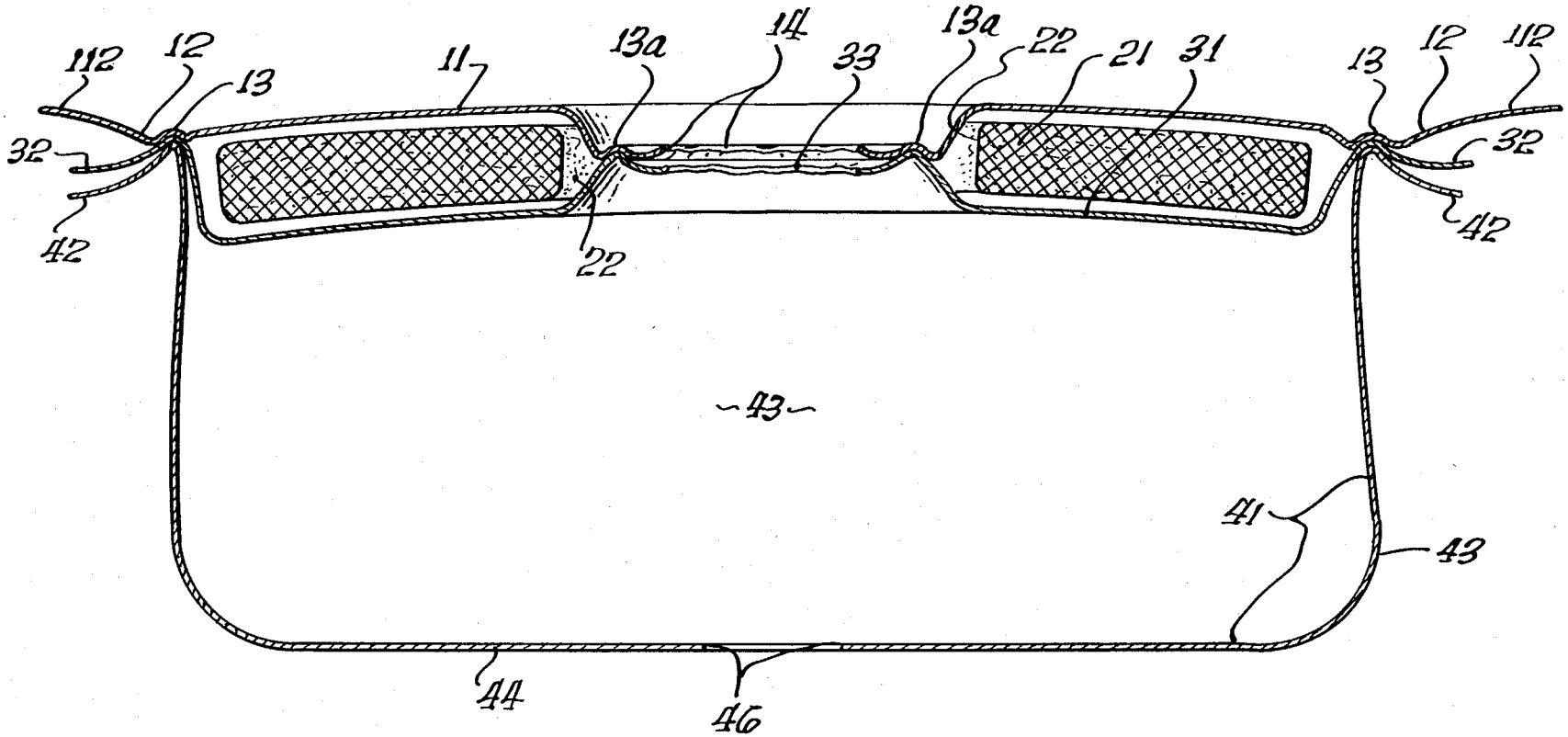
FIG. 3 is an elevation, mostly in section, of the FIG. 2 embodiment. For clarity

To avoid their sliding over and under one another in use or during filling or draining, they should be attached together by bridging members 112, preferably formed as the extensions of the individual top sheets 11 outside the sealing beads 13 (FIGS. 2 and 3). In other words, a single large sheet is advantageously used to form all of the top sheets 11 and the bridging members 112. If desired, for additional strength and stability this same arrangement may be used for two of the sheets—for example, the intermediate sheet 31 as well as the top sheet 11—or even for all three of the sheets.

In any event, the buoyantly suspended hydraulic chambers are connected together so that they form a unitary array such as a checkerboard pattern. It is advantageous to position the bridging sheets at the tops of the chamber assemblies, as that is where the best control of the buoyant forces is obtained.

FIG. 2 shows the float-and-baffle assembly in detail. At its heart is a quantity of preferably lofted fiber 21 that has relatively uniform density, thickness and width.

In this document, as generally in dictionary definitions, common usage, and trade usage, the term "lofted" means the opposite of "compressed" —that is to say, it conveys generally the same idea as "expanded" or "raised" or "puffed up". This concept is to be understood as compatible with *either* a woven regular structure, or a generally random intertwined and/or interbonded structure, though I prefer an unwoven structure.

Manufacturing details for the fibrous product are presented in my earlier patents, but briefly the fibers are advantageously polyester. The fibers may be garnetted as are those in my buoyant fiber product; however, for the present purposes they need not be.

The binder is preferably a cross-linking acrylic emulsion such as the binder marketed by Union Carbide of New York, N.Y. under the trademark "UCAR LATEX 879." The Rohm and Haas Company of Philadelphia, Pa. also markets a suitable binder under the trademark "Rhoplex TR-407." The binder should be diluted with a water solvent, as recommended by the manufacturer, to permit spraying. Binders utilizing nonaqueous solvents are not preferred.

The fiber carrying uncured or partially cured binder is passed through a conventional drying and curing oven, to produce the fibrous product 21 of FIG. 2. The heat of the oven evaporates the water solvent of the binder and cures the binder.

The binder, when it has cured, bonds substantially each fiber to—respectively—at least one other fiber. The entire mass of fibers is thereby linked together into a lofted matting.

The fiber mass is cut by conventional means into convenient lengths, which are in due course die-cut or otherwise chopped or shaped for use in the float-and-baffle assembly of my invention.

Fibers other than polyester may be found satisfactory, provided that the required float-distending properties are present. The fibers in the finished fibrous structure accordingly should be somewhat stiff.

As shown in FIGS. 2 and 3, this fibrous product is sealed, along with a quantity of air or other gas, within the float. Most of the features in FIG. 2 are shown cut away at 51, to reveal the details of internal construction.

The article shown in these drawings includes a generally rectangular piece or mat of my fibrous product 21, incorporated into an enclosed vinyl or like plastic sheeting structure 11-31-41. One portion 41 of this sheeting structure forms a hanging baffle.

Advantageously the downwardly hanging parts 43 of this baffle portion 41 are continued in a generally horizontal part 44 that interconnects the downwardly hanging parts—creating, in effect, wall sections 43 and a floor section 44, to make a baffle of the type known as a "hydraulic chamber". Other baffle types, however, may be used within the scope of my invention.

The floor section 44 of the baffle portion 41 defines a generally central hole 46. The wall sections 43 are drawn together and fused in a weld seam along each of the four generally vertical corners of the chamber, with the tailing edges conveniently extended inward within the chamber as at 45. Two of these corner seams may, if desired, be extended all the way to the floor section 44; rather, apertures 47 may be left at the bottoms of some or all of the corners. I consider it particularly advantageous to have apertures at at least two diagonally opposite corners to facilitate drainage when the water is to be emptied from the mattress. It often happens that one side or quadrant of the baffle structure may come to rest in a slightly raised position, and this happenstance can trap water within the baffle structure if the raised portion also happens to be the only part that has a drainage aperture. Such trapping is almost always avoided by putting apertures in two diagonally opposite corners—since, if one or the other corner is raised, the opposite corner is almost always in a relatively very low position.

The sheeting structure 11-31-41 also includes a top sheet 11 and an intermediate sheet 31 that are secured to the baffle portion 41, and between which is sealed the fibrous mat 21. The sheets 11 and 31 thus constrain the fibrous pad 21 in close proximity to the baffle. In effect the top sheet 11 and intermediate sheet 31 cooperate to form a shaped pocket within which the pad 21 is sealed.

The two sheets 11 and 31 may advantageously be square or rectangular, and of the same vinyl or like plastic material as the baffle portion 41. All three may be secured together as by a welded seam 13 running entirely or generally around the periphery of the top sheet 11, with the tailing edges 12, 32 and 42 extending outward.

At least one of these edges, preferably the upper tailing edge 12, is in fact to be extended outwardly on some sides, as at 112, across a gap of several inches; and is continued as the corresponding top sheet 11 of another hydraulic chamber. The outer edges of the extension 112 are simply shown broken away, to limit the size of the drawing.

The two upper sheets 11 and 31 have mutually aligned holes 14 and 33, respectively, for passage of water between the interior of the hydraulic chamber 41 and the space above the top sheet 11. The edges of these two holes 14 and 33 are cosealed along their whole lengths, as by a welded seam 13*a* like the external seam 13 discussed above.

Similarly the fibrous mat 21 has a hole 22 that is generally concentric with the holes 14 and 33 in the upper sheets 11 and 31. The hole 22 in the fibrous mat, however, is larger in diameter than the holes 14 and 33 in the sheets, so that the edges of the latter holes can be welded together without catching the edge of the internal hole 22 in the mat. (If a weldable material were substituted for the fibers, it could be possible to make a circular weld and cut the central hole in a single operation.)

The result, as may be seen in the drawings, is a hole 33 passing entirely through the sealed structure of the float 11-21-31. A single hole that is generally central as illustrated, forming an externally square toroid, is satisfactory. If desired, however, this passageway may be replicated at more than one point in the float to form a plurality of passages.

The passage 33 permits escape of entrapped air and facilitates water circulation between the interior of the hydraulic chamber and the space above the top 11—for the various purposes mentioned in the earlier discussion.

If such a passage or passages are not provided, trapped air generates an objectionable sloshing or gurgling sound within the mattress during use. Thermal convection and consequently temperature equalization within the mattress depend on the circulation provided by the aperture 33.

The fibrous pad 21 in this assemblage forces the mutually sealed sheets 11 and 31 above and below it into a very roughly constant shape and volume, so that the pad has a very roughly consistent buoyancy for support of the hydraulic chamber 41.

The chamber 41 attenuates motion of water within the enclosing waterbed mattress. In addition, as previously mentioned, the float 11-21-31 itself, by friction in the flow of water in and out through the central orifice 33, provides additional wave attenuation that may be useful when a wave is first forming. It is to be understood that this effect is typically small, but for some configurations is expected to be significant.

It is particularly in order to perform this function more effectively that the central hole may be reconfigured as a plurality of holes. The greater the tendency of waves to force water in and out through the hole(s), the greater the significance of this wave-retarding function of the float.

When water enters the hole in the float as just described, it becomes possible to logically regard the top sheet 11 and intermediate sheet 31 as forming part of the hydraulic chamber. For the purpose of definiteness of description and claims, however, in this document the "hydraulic chamber" is taken to be separate from the sheets 11 and 31, and is thus limited to the lower portions which are designated by the reference numerals 41 and 44. Hence it is correct to say that the constraining elements 11 and 31 constrain the float structure above the baffle 41—or above the hydraulic chamber 41-44.

By virtue of greater flexibility and possibly lower overall density of the fibers, the structure of my invention would be less bulky in shipment than encapsulated polyethylene foam.

Although preferred embodiments of my novel float with hanging baffle have been disclosed, it will be apparent to those familiar with the art that modifications can be made without departing from the scope of the invention—which is defined only by the appended claims.

I claim:

1. In a noninsulating combination, for use within a waterbed mattress or the like to reduce wave motion of water therein while maintaining heat flow from the bottom to the top thereof:

a fibrous product comprising a large multiplicity of interbonded fibers;

a first sheeting structure that forms a baffle for reducing such wave motion by partially impeding movement of such water within the mattress;

the baffle being shaped to define an extended bottom panel of an enclosure for occupancy by some of such water;

the baffle being further shaped to define side panels of the enclosure, said side panels being substantially continuous with the extended bottom panel;

a horizontal dimension of the baffle being at least twice the height of the baffle;

the baffle having first hole means formed therein for passage of such water into and out from said enclosure so that such water occupying the enclosure is not completely confined within said enclosure but can circulate into and out from said enclosure;

the first hole means constituting in area substantially less than ten percent of the area of the horizontal portion of the baffle, but nevertheless being amply sized to facilitate sufficient water circulation by convection through the baffle to prevent the baffle from thermally insulating the top of the mattress from the bottom;

the baffle further having apertures defined in diagonally opposite lower corners thereof;

a second sheeting structure that entirely encloses the fibrous product and that forms a sealed gas space, the fibrous product being inside the gas space and tending to prevent the sealed gas space from collapsing; and means for constraining the second sheeting structure in close proximity to the baffle, so that the second sheeting structure with its sealed gas space can by its buoyancy support the baffle and can form the top of said enclosures for occupancy by such water;

the second sheeting structure defining sealed second hole means for communication of space above the second sheeting structure with space below the second sheeting structure, the second hole means being disposed generally within a central expanse of the second sheeting structure and being amply sized to facilitate sufficient water circulation by convection through the second sheeting structure to prevent the second sheeting structure from thermally insulating the top of the mattress from the bottom;

whereby such water within such mattress of the like, when it fills the space in and around the sheeting structures and the constraining means, can circulate through the hole means and through the baffle and thereby promote temperature equalization of such water above and below the baffle by convection;

a part of the second sheeting structure being laterally extended as a bridging member to at least one other like combination as defined in all the foregoing paragraphs of this claim.

2. The combination of claim 1, wherein:

the constraining means constrain the second sheeting structure above the baffle.

3. The combination of claim 1, wherein:

the first and second sheeting structures are respective parts of a unitary sheeting structure.

4. A plurality of the combinations defined in claim 1, connected together by a bridging member.

5. The combination of claim 1 wherein:

the hole means comprise one substantially central hole passing entirely through the second sheeting structure; and the second sheeting structure is very generally toroidal.

6. The combination of claim 1, wherein:

the enclosure has a volume of at least four percent of the volume of the waterbed, and such water partially confined within the enclosure constitutes at least four percent of the water within the waterbed; and the baffle is substantially free of weights, other than the unavoidable weight of the sheeting structure itself, so that the sheeting structure and such water partially confined within the enclosure are substantially free to move in response to such wave motion, opposed substantially only by the internal friction of such water, and not opposed by action of weights.

7. The combination of claim 6, wherein:

a horizontal dimension of the enclosure is roughly twenty inches; and the depth of the enclosure is roughly eight inches.

8. The combination of claim 6, wherein:

the enclosure is roughly twenty inches square and eight inches deep.

* * * * *